US006857366B1

(12) United States Patent
Nikkanen

(10) Patent No.: US 6,857,366 B1
(45) Date of Patent: Feb. 22, 2005

(54) PRINTING PRESS INK TRANSFER MECHANISM AND EMPLOYMENT OF SAME

(76) Inventor: Erik Nikkanen, 415-1004 Lawrence ave. East, Toronto, Ontario (CA), M3C 1R5

( * ) Notice: Subject to any disclaimer, the term of this patent is extended or adjusted under 35 U.S.C. 154(b) by 216 days.

(21) Appl. No.: 09/703,623

(22) Filed: Nov. 2, 2000

Related U.S. Application Data

(60) Provisional application No. 60/168,756, filed on Dec. 6, 1999.

(30) Foreign Application Priority Data

Nov. 2, 1999 (CA) ..... 2288354

(51) Int. Cl.[7] ..... B41F 3/00

(52) U.S. Cl. ..... 101/483; 101/350.2; 101/367

(58) Field of Search ..... 101/350.2, 350.5, 101/350.1, 351.1, 364, 367, 473, 350.6, 351.2, 351.3, 351.4, 352.01, 352.05, 352.07, 352.08, 369, 366, 178

(56) References Cited

U.S. PATENT DOCUMENTS 1,981,912 A * 11/1934 Fankboner ..... 101/350.5
2,376,620 A * 5/1945 Piazze ..... 101/350.5
2,393,838 A 1/1946 Tarbox
2,650,537 A * 9/1953 Rosse ..... 101/350.5
3,606,596 A 9/1971 Edwards
3,658,445 A 4/1972 Pulman et al.
4,186,661 A * 2/1980 Vieau ..... 101/178
4,236,881 A 12/1980 Pfleger
4,479,761 A 10/1984 Bilstad et al.
4,497,250 A * 2/1985 Dressler ..... 101/366
4,657,490 A 4/1987 Abbott
4,688,482 A * 8/1987 Tobias ..... 101/350.6
4,846,635 A 7/1989 Fry et al.
5,042,381 A 8/1991 Thompson et al.
5,158,437 A 10/1992 Natwick et al.
5,252,044 A 10/1993 Raines et al.
5,289,772 A 3/1994 Kohara et al.
5,778,785 A * 7/1998 Blackwell ..... 101/365

* cited by examiner

*Primary Examiner*—Eugene H. Eickholt
(74) *Attorney, Agent, or Firm*—McCarthy Tetrault LLP; John R. S. Orange; Santosh R. Chasi

(57) ABSTRACT

A printing press ink transfer mechanism includes a primary flow metering device to monitor the flow ink supply and a secondary flow metering device to monitor the return flow of the ink to the supply. The difference in ink flow between the supply and return is delivered to the application rollers of a printing press.

12 Claims, 8 Drawing Sheets

PRINTING PRESS INK TRANSFER MECHANISM AND EMPLOYMENT OF SAME

This application claims benefit from U.S. Provisional Patent Application No. 60/168,756, filed Dec. 6, 1999.

The present invention relates to the transfer of ink in a printing press.

BACKGROUND OF THE INVENTION

Modern printing presses are designed to operate at high speeds and are expected to produce quality images at variable press speeds, water settings, and press temperatures. There currently exists a problem of inconsistent colour control in modern printing presses due to changes in the above mentioned parameters. One potential error source is in the method of ink transference from the ink fountain roller to the high speed roller train of the press.

Modern press designs have two different types of ink ductors, either intermittent or continuous. The disadvantage of these designs is that they both suffer from inconsistent ink transfer. The ink supply is initially metered by an ink fountain blade and then transferred by way of the ductor to the high speed roller train of the press. One disadvantage of this system is that in transferring the metered ink flow rate from the ink fountain roller, a certain portion of the ink may not be transferred and will therefore be returned to the ink fountain. As such, the amount of ink transferred to the press is not known.

The net transfer of ink to the printing press is preferred to be in a state of equilibrium for most printing applications. This equilibrium is easily disturbed by changes in variables such as press speed, water setting, and temperature of the high speed roller train. After such disturbances, a new equilibrium is established that results in a new and usually different ink transfer rate to the printing press. The disadvantage of this is that if the metered ink flow rate supplied by the fountain blade is constant, the ink transfer rate to the printing press must change with the change in variables. This variability in ink transfer rate could eventually result in an undesired solid colour density change of the printed material produced by the printing press.

Another disadvantage with present printing press systems is that adjustments have to be made to the ink flow settings when the press runs at different speeds. The correct setting of ink keys and ink fountain roller settings to provide a desired ink transfer rate are not always predictable.

It is an object of the present invention to obviate or mitigate the above mentioned disadvantages.

SUMMARY OF THE INVENTION

The present invention provides a printing press ink transfer mechanism including a supply roller to collect ink from an ink supply. A primary flow metering device for the ink and a secondary flow metering device for the ink are coupled to the supply roller on opposite sides of a liquid flow output. A measurable difference in flow of the ink between the metering devices is supplied to an ink flow output. A plurality of transfer rollers can be employed to transfer the flow output to the printing press.

A further aspect of the invention provides a method of metering ink from a supply roller including the steps of (a) metering a flow of the ink onto the supply roller to produce a primary flow, (b) metering of the primary flow transferred by the supply roller to produce a secondary flow, (c) separating a difference between the primary flow and the secondary flow from the supply roller to produce a tertiary flow, directed away from the supply roller.

BRIEF DESCRIPTION OF THE DRAWINGS

These and other features of the preferred embodiments of the invention will become more apparent in the following detailed description in which reference is made by way of example only to the appended drawings wherein.

DESCRIPTION OF THE PREFERRED EMBODIMENTS

Figure 1:
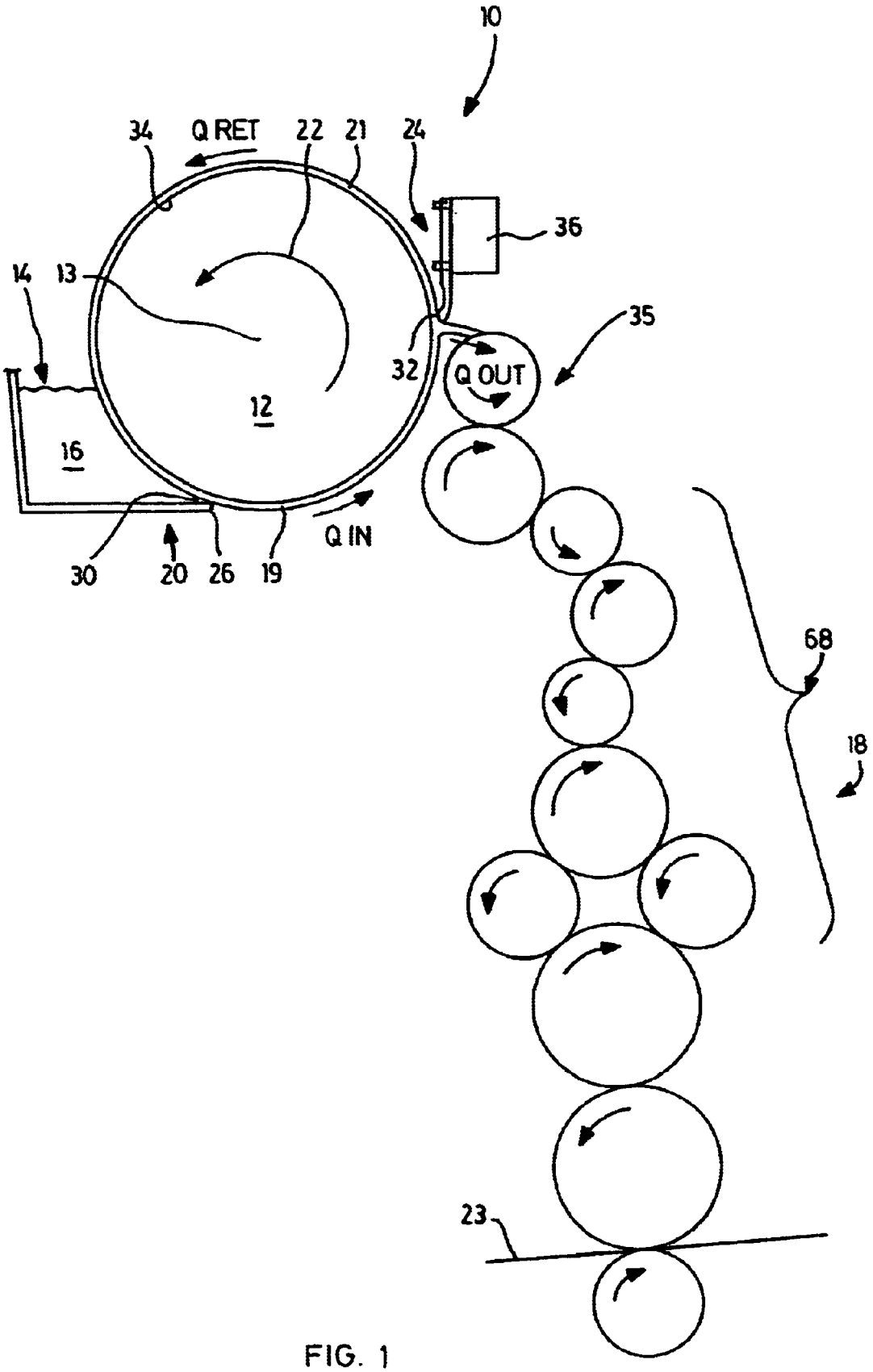
FIG. 1 is a side view of an ink transfer mechanism for a printing press.

Referring to FIG. 1 a ink transfer mechanism 10 suitable for a printing press 18 includes a supply roller 12, having an exterior surface 34 and rotatable about an axis 13. A reservoir 16 contains ink 14, which is metered onto the exterior surface 34 by a first blade assembly 20. The first blade assembly 20 includes a blade 26 which is spaced from the external surface 34 by a supply gap 30. The supply gap 30 is set by adjusting a position of the first blade 26 relative to the external surface 34 to control the thickness of a film 19 applied to the external surface 34. The blade assembly 20 is of conventional construction as is well known in the art and therefore will not be described in further detail.

Figure 2:
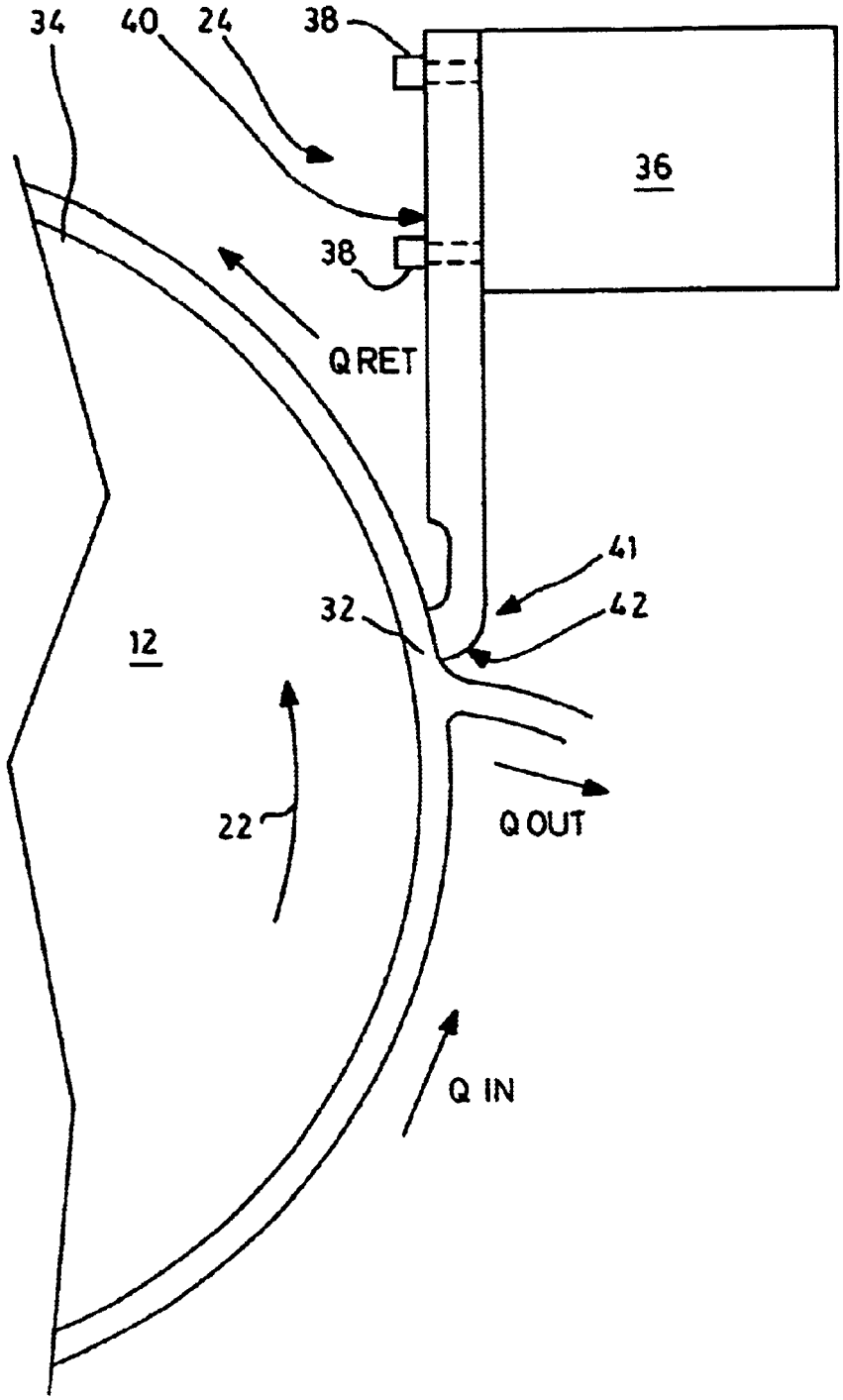
FIG. 2 is an enlarged view of FIG. 1.

A second blade assembly 24 is spaced along the circumference of the roller 12 in the direction of rotation 22 and meters the ink 14 returned to the reservoir 16. The second blade assembly 24 includes a blade portion 41, as shown in FIG. 2, that is spaced from the exterior surface 34 to provide a return gap 32. The thickness of a return film 21 is controlled by setting the position of the blade portion 41 with respect to the exterior surface 34, which defines the return gap 32. A typical operational range for the return gap 32 is 0.001 inches to 0.006 inches. The blade assembly 24 may move from an operative position, in which the metered blade 24 is held at the operative gap 32 to a retracted position in which the blade is moved away from the roller 12 to permit unmetered return of the ink.

The first blade assembly 20 determines the flow rate of ink 14 from the reservoir 16, indicated as $Q_{in}$, and the second blade assembly 24 determines the rate of flow of ink 14 returned to the reservoir 16, indicated as $Q_{ret}$. The difference in the flow rates $Q_{in}$, $Q_{ret}$ determines an output flow rate $Q_{out}$ that is delivered from the roller 12 to a transfer roller assembly 35 and onto a printing web 23 of the printing press 18. By adjusting the gap 30 and the speed of the roller 21 relative to the speed of the press 18, the output flow rate $Q_{out}$ is adjusted accordingly.

Figure 3:
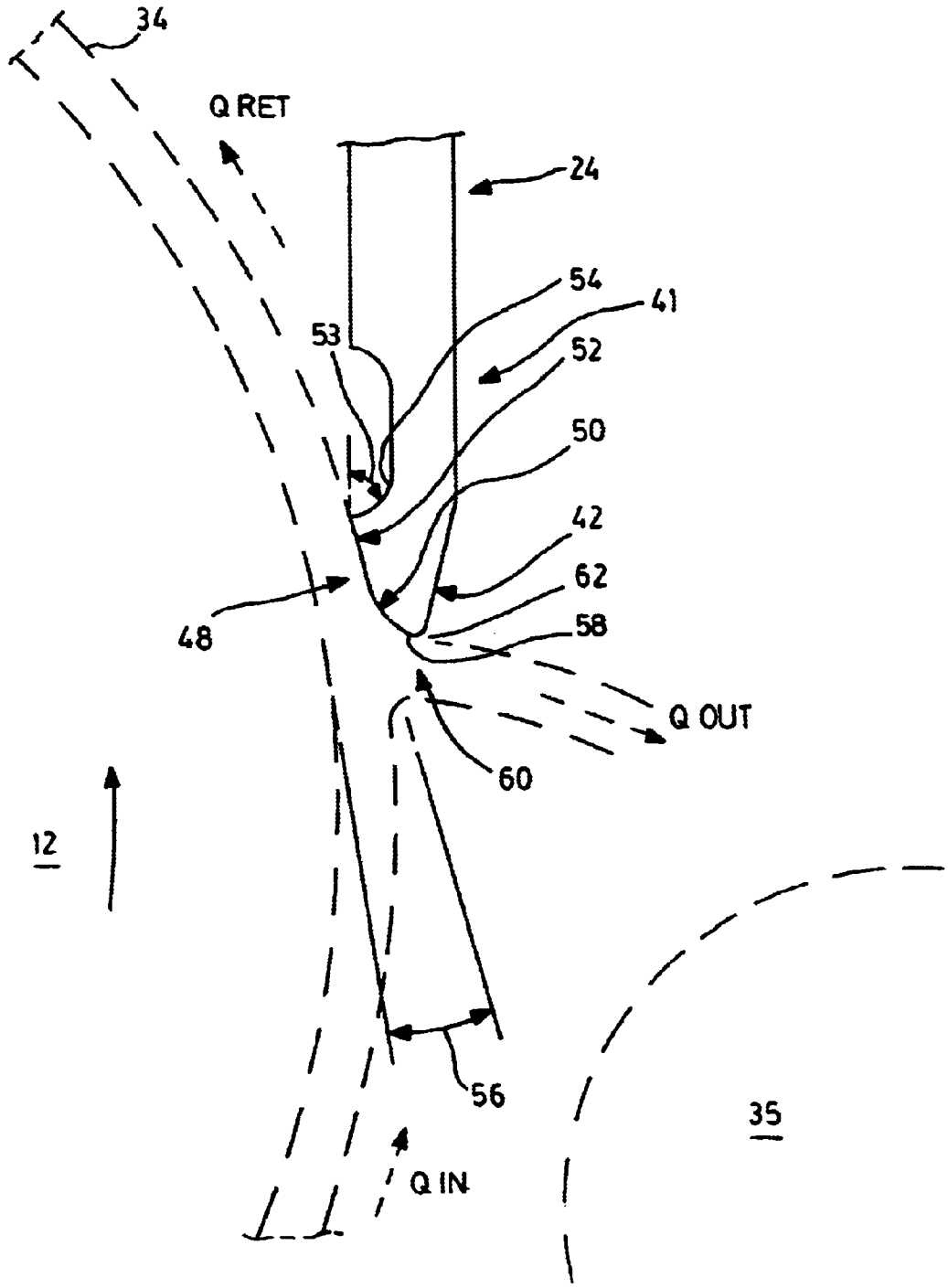
FIG. 3 is an enlarged view of FIG. 2.

As can best be seen in FIG. 2, a pair of bolts 38 mount the second blade assembly 24 onto a support structure 36. The support structure 36 is sufficiently rigid to facilitate negligible variability in the gap 32, once set to a desired tolerance. Referring to FIG. 3, the tip 42 of the blade portion 41 has a contoured surface 48 directed toward the exterior surface indicated at 34 in ghosted view. The contoured surface 48 includes an arcuate entrance 50, a middle section 52 substantially parallel to a tangent of the surface 34, and a sharp exit 54. The contoured surface 48 helps to inhibit a vena contracta condition in the return flow $Q_{ret}$, a phenomena well known in the art of fluid mechanics. The entrance 50 has a shallow approach angle 56 of less than twenty degrees, the middle section 52 measures approximately 0.01 inches to 0.02 inches, and the exit angle 53 is approximately 90° with respect to the exterior surface 34.

Figure 4:
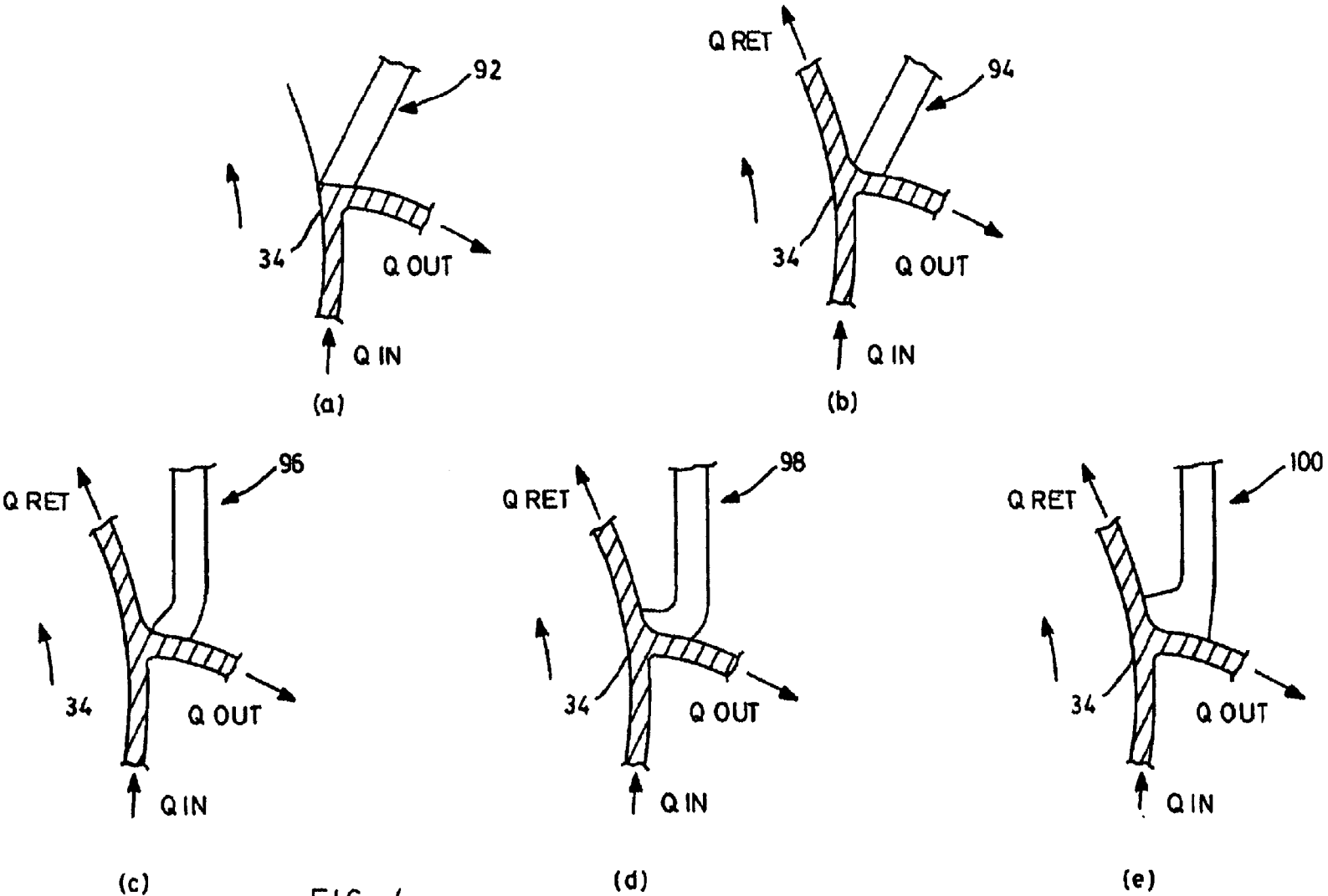
FIG. 4 shows further embodiments of the blade portion of FIG. 3.

The output flow $Q_{out}$ is directed away from the entrance region 50 of the blade portion 41 towards the transfer assembly 35 by a transfer surface 58. The transfer surface 58 is located on a extremity 60 of the blade portion 41 and helps to direct the output flow $Q_{out}$ almost perpendicularly away from the exterior surface 34 of supply roller 12. In the preferred embodiment, the transfer surface 58 is relatively short, approximately 0.10 inches, in order to inhibit a reduction in the flow speed and possible collection of the output flow $Q_{out}$ on the extremity 60. A sharp corner 62 is located at the end of the transfer surface 58 to encourage the output flow $Q_{out}$ to separate and fall into the transfer assembly 35. As shown in FIG. 4, gives example various geometries of the blade portion 41, as indicated by blade portions 92, 94, 96, 98, and 100 may be used. The geometry of the second blade assembly 24 and the magnitude of the return gap 32 for a particular application can depend on considerations pertaining to the design of the first blade assembly 20, viscosity of the ink 14, simplicity of manufacture, and ease of cleaning the blade assembly 24.

Figure 5:
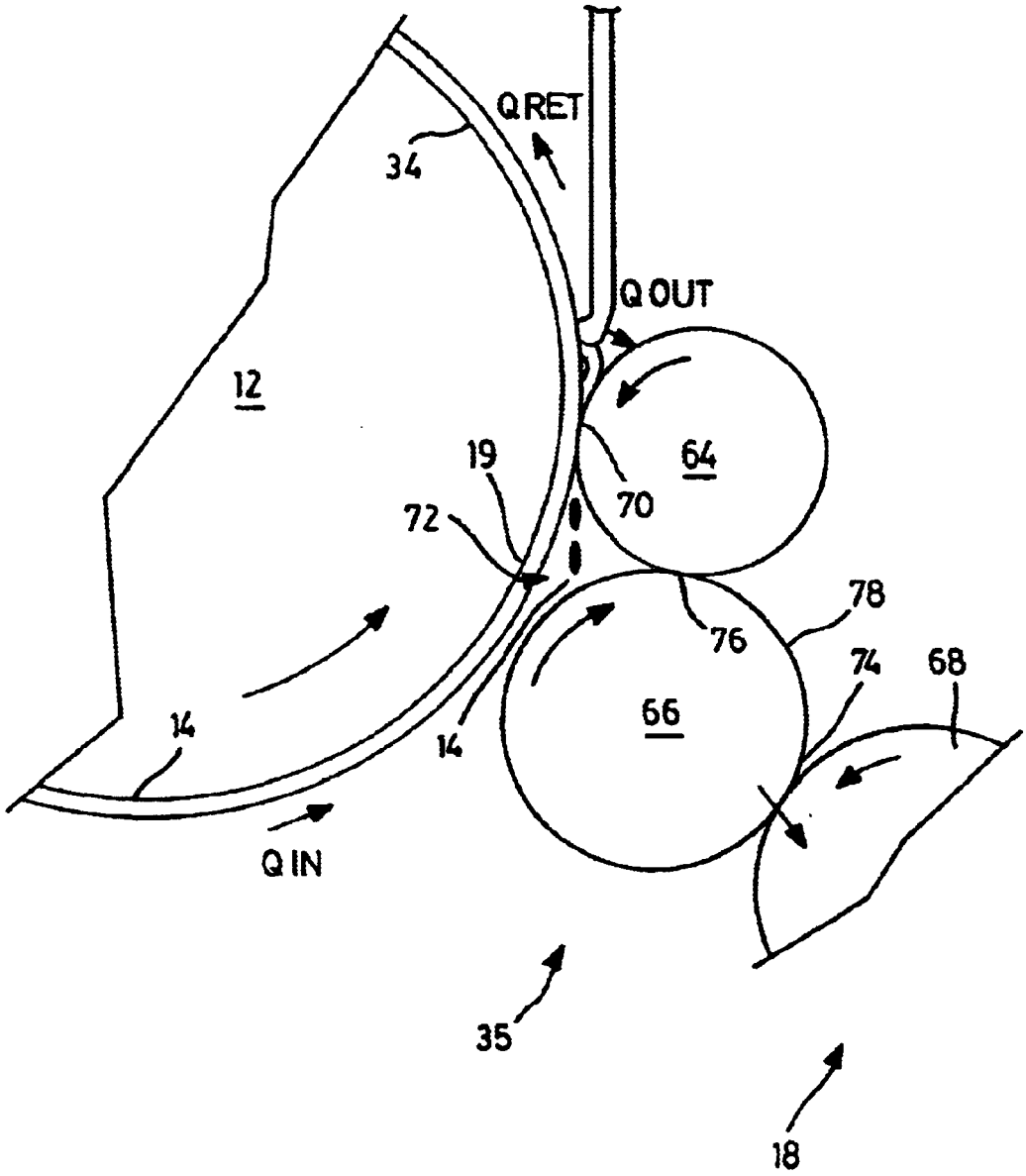
FIG. 5 is a further embodiment of FIG 1.

Referring to FIG. 5, the transfer assembly 35 comprises a series of transfer rollers 64, 66, which are employed to transfer the metered output flow $Q_{out}$ to a high speed roller train 68 of the printing press 18. The rotating transfer rollers 64, 66 are held in a fixed spatial position with respect to the rollers 12 and 68. The roller 66 preferably has a squeeze nip contact 74 with the first roller in the roller train 68. The roller 64 also has a squeeze nip contact 76 with the roller 66. A transfer gap 70 is maintained between the roller 64 and the supply roller 12, which permits access of the output flow $Q_{out}$ to the roller 66. A pocket 72 between the rollers 12, 64, 66 is positioned so as to direct ink 14 directed from the transfer gap 70 to the squeeze nip 76. In the preferred embodiment, the transfer gap 70 is larger than the maximum thickness of the input film 19. In the case where the ink transfer operation is improved by having the gap 70 at a value less than the maximum input film 19, then roller 64 is retracted to a position that makes gap 70 greater than the maximum input film 19 during the non operating condition. A typical range for the transfer gap 70 is 0.02 inches to 0.03 inches.

Figure 8:
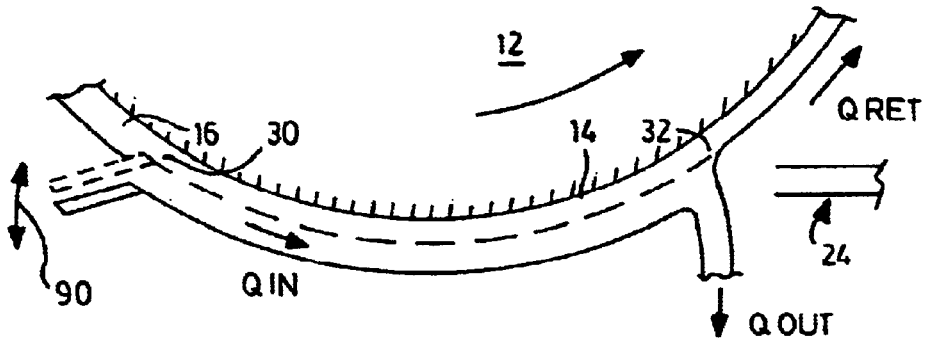
FIG. 8 shows various operational settings of the embodiment of FIG. 1.

In operation of the fluid transfer mechanism 10, reference is made to FIGS. 1, 5, and 8. The ink 14 is deposited onto the rotating supply roller 12, as the exterior surface 34 is passed through the reservoir 16. The first blade assembly 20 meters the input flow $Q_{in}$ to the desired film thickness 19. The exterior surface 34 of the supply roller 12 carries the input flow $Q_{in}$ relatively undisturbed, until it comes into contact with the second blade assembly 24. At this point the flow $Q_{in}$ is separated into the constant return flow $Q_{ret}$ which passes through the gap 32 and the output flow $Q_{out}$ which is directed away from the surface 34 by the second blade portion 41 to the transfer mechanism 35 (not shown).

The second blade assembly 24 meters the return flow $Q_{ret}$ to the film thickness 21, which is carried by the roller 12 back to the reservoir 16. The resultant difference between the metered input flow $Q_{in}$ and the metered return flow $Q_{ret}$, namely the output flow $Q_{out}$, moves along the transfer surface 58 of the extremity 60. In this manner, the resultant flow rate of the output flow $Q_{out}$ is also metered. Once the flow $Q_{out}$ separates from the blade portion 41, the flow $Q_{out}$ falls onto the roller 64 and is directed into the transfer gap 70. At this stage, the flow $Q_{out}$ is either sprayed into the pocket 72 and carried by the roller 66 to the squeeze nip contact 76, or the flow $Q_{out}$ is carried directly by the roller 64 to the squeeze nip contact 76.

The nip contact 76 can be used to limit the thickness of the ink film 78 contacting the roller train 68. This can be done by choosing higher durometer values for the roller 64 or 68, which will effectively smooth out random ink film variations. The roller 68 then supplies this conditioned ink film to the press 18. The metered film thicknesses 19, 21 facilitate repeatable measurements of the ink 14 entering the printing press 18, namely the output flow $Q_{out}$ for a constant values of a rotational speed of the supply roller 12.

Figure 6:
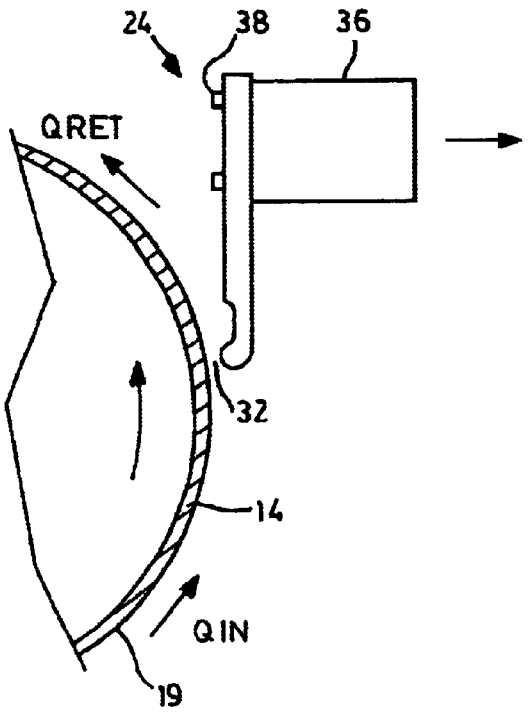
FIG. 6 demonstrates a disengagement position of the blade assembly of FIG. 1.

Referring to FIG. 6 the blade assembly 24 is shown in a retracted position, i.e. in a spaced apart relationship with respect to the roller 12, in which the return gap 32 is greater than the input film thickness 19. This retracted position results in the return flow $Q_{ret}$ equaling the input flow $Q_{in}$ which provides for a zero output flow $Q_{out}$. When the support structure 36 is displaced towards the roller 12, shown in FIG. 7, the second blade assembly 24 comes into an operative position, i.e. close proximity with the surface 34 of the roller 12. In the operative position the return gap 32 is less than the input film thickness 19. This allows the secondary blade assembly 24 to divide the input flow $Q_{in}$ into a decreased return flow $Q_{ret}$ and the resulting output flow $Q_{out}$, where $Q_{out}=Q_{in}-Q_{ret}$.

Figure 7:
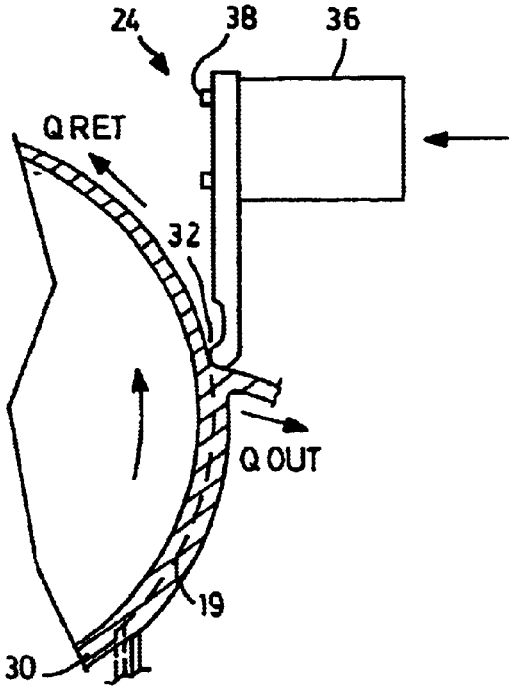
FIG. 7 demonstrates an engagement position of the blade assembly of FIG. 1.

As shown in FIG. 8, the zero $Q_{out}$ condition can also be obtained by restricting the supply gap 30 to less than that of the return gap 32, when the blade assembly 24 is in the engaged position of FIG. 7. This flow setting also makes the input flow $Q_{in}$ equal to the return flow $Q_{ret}$, thereby inhibiting the flow of ink 14 to the printing press 18. By adjusting the gap 30 of the blade assembly 20 with respect to the surface 34, as shown by arrow 90, the output flow $Q_{out}$ may be monitored and adjusted accordingly.

The employment of the blade assemblies 20, 24 facilitate a repeatable measurement of the fluid volume contained in the output flow $Q_{out}$ for a prescribed speed of the roller 12. This fluid volume calculation is based on the difference in measured film thicknesses 19, 21 of the flows $Q_{in}$, $Q_{out}$ respectively.

Figure 9:
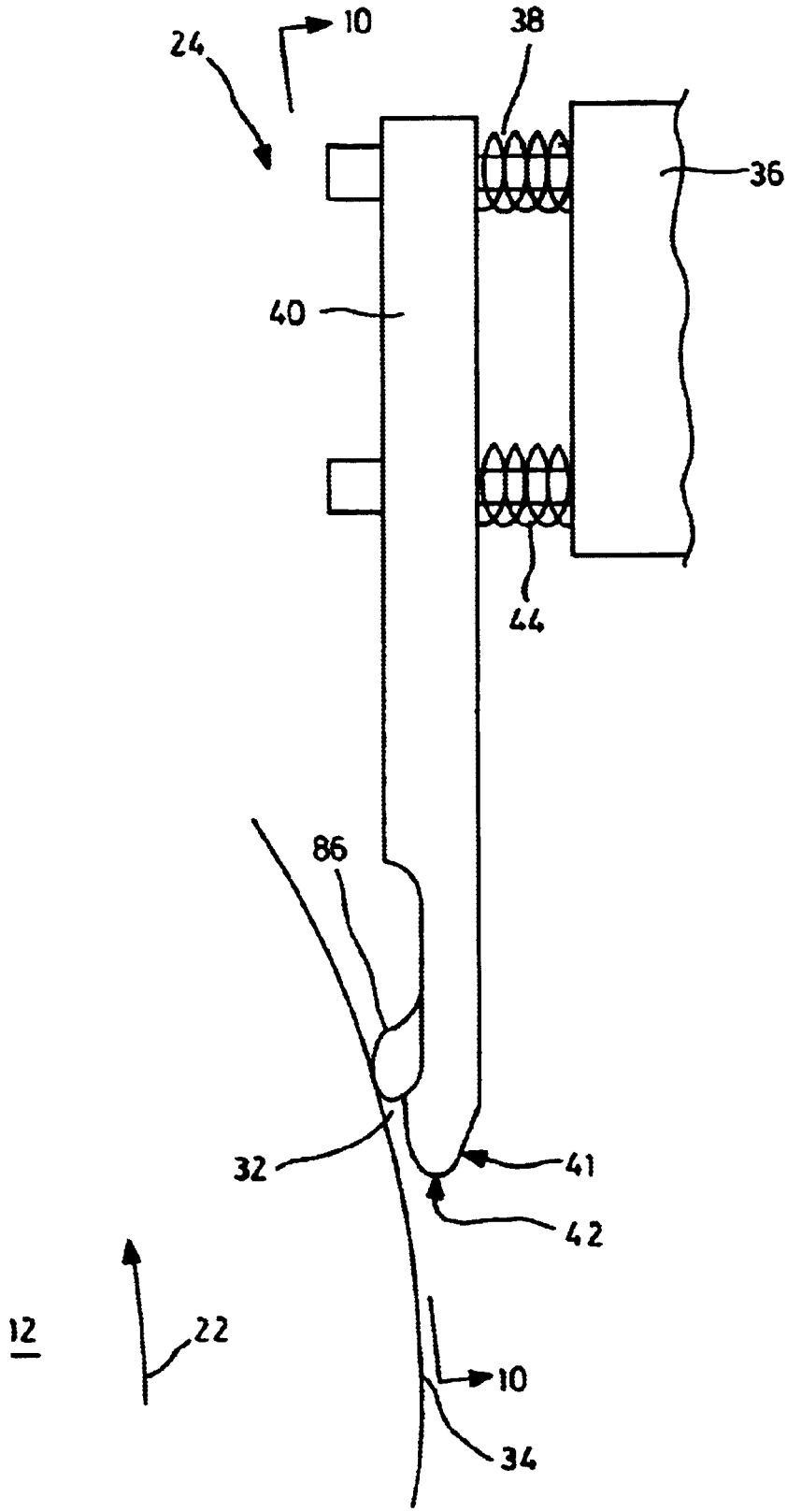
FIG. 9 is a further embodiment of FIG. 1.
Figure 10:
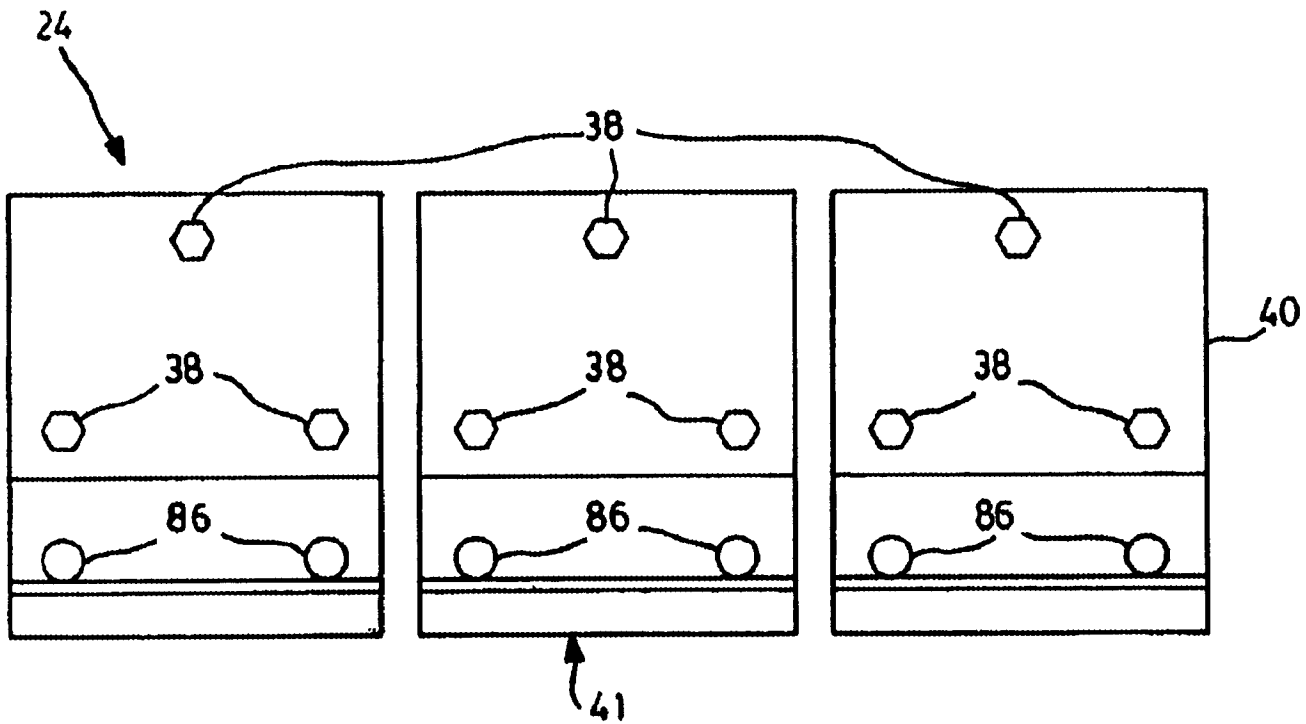
FIG. 10 is a section 10—10 view of FIG. 9.

In a further embodiment, a plurality of spacers 86 are attached to the second blade portion 41 shown in FIGS. 9 and 10. The thickness of the spacer 86 dictates the magnitude of the return gap 32. A coil spring 44 is positioned on the bolts 38 to provide constant contact between the spacer 86 and the surface 34, which helps to provide a constant return gap 32 for a particular operational setting of the second blade assembly 24. The coil spring 44 acts on the shaft 40 to bias the tip 42 of the attached blade portion 41 towards the surface 34. Incorporation of the spacers 86 and coil springs 44 in the second blade assembly 24 facilitates the employment of a more flexible support structure 36, if desired. The spacer 86 can be attached onto the blade portion 41 by machining, welding, or mechanically.

The printing press ink transfer mechanism 10 can be applied to a number of press types such as lithograph, letterpress, dry offset, waterless offset, as well as coaters. The mechanism 10 can also be applied to web or sheet fed processes, open ink fountains, or inkers that pump ink 14 onto the ink fountain roller 12 via ink rails. It is appreciated that transfer assemblies 35 other than those described may be substituted. Differently configured second blade assemblies 24 may be used to provide metering for the return flow $Q_{ret}$, such as blade tips with different shapes or scrapers that are in direct contact with the supply roller 12. It is recognized that the first blade assembly 20 and the second blade assembly 24 can be composed of a plurality of adjacent sections distributed along the length of the roller 12, if desired.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. An ink transfer mechanism for printing press including a supply roller to collect ink from a liquid supply, a primary flow metering device to produce a primary flow of said ink carried by said roller, and a secondary flow metering device spaced from said primary flow metering device to provide a continuous and constant secondary flow on said roller, said secondary flow metering device including a blade portion, whereby a difference in the flow of said liquid between said metering devices is supplied to a flow output.

2. An ink transfer mechanism according to claim 1, wherein said secondary flow metering device is biased towards said supply roller.

3. An ink transfer mechanism according to claim 1, wherein said secondary flow metering device is movable relative to said supply roller between an operative position which provides a predetermined separation distance between said blade portion and an outer surface of said supply roller, and an inoperative retracted position.

4. An ink transfer mechanism according to claim 1, wherein said blade portion includes a contoured surface portion.

5. An ink transfer mechanism according to claim 4, wherein said contoured surface portion is arcuate.

6. An ink transfer mechanism according to claim 2, wherein a predetermined magnitude of said separation distance is maintained by an element located between said exterior surface and said blade portion.

7. A method of metering ink from a supply roller of a printing press including the steps of: metering of a flow of said ink onto said supply roller by application of a primary metering device to produce a primary flow, applying a blade portion of a secondary metering device to said supply roller to meter said primary flow transferred by said supply roller to produce a secondary flow on said roller, directing a difference between said primary flow and said secondary flow from a surface of said supply roller to produce a tertiary flow as an output.

8. A secondary flow metering device to meter the return flow of ink supply of a printing press comprising a body and a blade portion connected to said body, said blade portion being supported by said body to engage a primary flow of ink on a supply roller to divide said flow into a secondary flow for return to said supply and a tertiary flow to a flow output.

9. A metering device according to claim 8, wherein an end portion of said blade portion is arcuate.

10. The metering device of claim 8, wherein said blade portion includes a contoured surface having an entrance region, a middle region, and an exit region.

11. A metering device according to claim 10, wherein said entrance region contains a shallow angle of less than 20 degrees with respect to an adjacent surface.

12. A metering device according to claim 8, wherein an end portion of said blade portion includes a corner region to promote separation of ink flow along said end portion.

* * * * *